United States Patent [19]

Atkinson

[11] 4,031,724

[45] June 28, 1977

[54] KEY CONTROLLED LOCK MECHANISMS FOR ZIPPER FASTENERS

[75] Inventor: Wallace E. Atkinson, Petersburg, Va.

[73] Assignee: Long Manufacturing Co., Inc., Petersburg, Va.

[22] Filed: Oct. 20, 1976

[21] Appl. No.: 734,119

[52] U.S. Cl. ..... 70/68; 70/70; 70/75

[51] Int. Cl.[2] ..... E05B 65/32

[58] Field of Search ..... 70/2, 6–13, 70/60–76; 292/101, 108, 128, 202, 210, 228

[56] References Cited

UNITED STATES PATENTS

| | | | |
|---|---|---|---|
| 320,036 | 6/1885 | Adams | 70/70 |
| 663,413 | 12/1900 | Bernstein | 70/75 X |
| 781,621 | 1/1905 | Salviolo | 70/75 |
| 3,312,089 | 4/1967 | Atkinson | 70/70 |

FOREIGN PATENTS OR APPLICATIONS

| | | | |
|---|---|---|---|
| 779,191 | 1/1935 | France | 70/70 |

*Primary Examiner*—Robert L. Wolfe
*Attorney, Agent, or Firm*—Mason, Fenwick & Lawrence

[57] ABSTRACT

A key controlled lock mechanism for locking one or more sliders of a zipper fastener, wherein the lock member is of circular disc-like configuration having a cup-shaped cylindrical casing and a rear backing plate assembled together with a circular latch plate rotatable through an arc therebetween. The latch plate has a latch tongue and a recess receiving a key operated locking disc journaled in the casing and shaped to selectively lock or release the latch plate. Various forms of keepers are disclosed to be mounted on a receptacle closed by the zipper fastener or to be coupled with the pull tab of the zipper slider or formed by special shaping of the slider.

18 Claims, 12 Drawing Figures

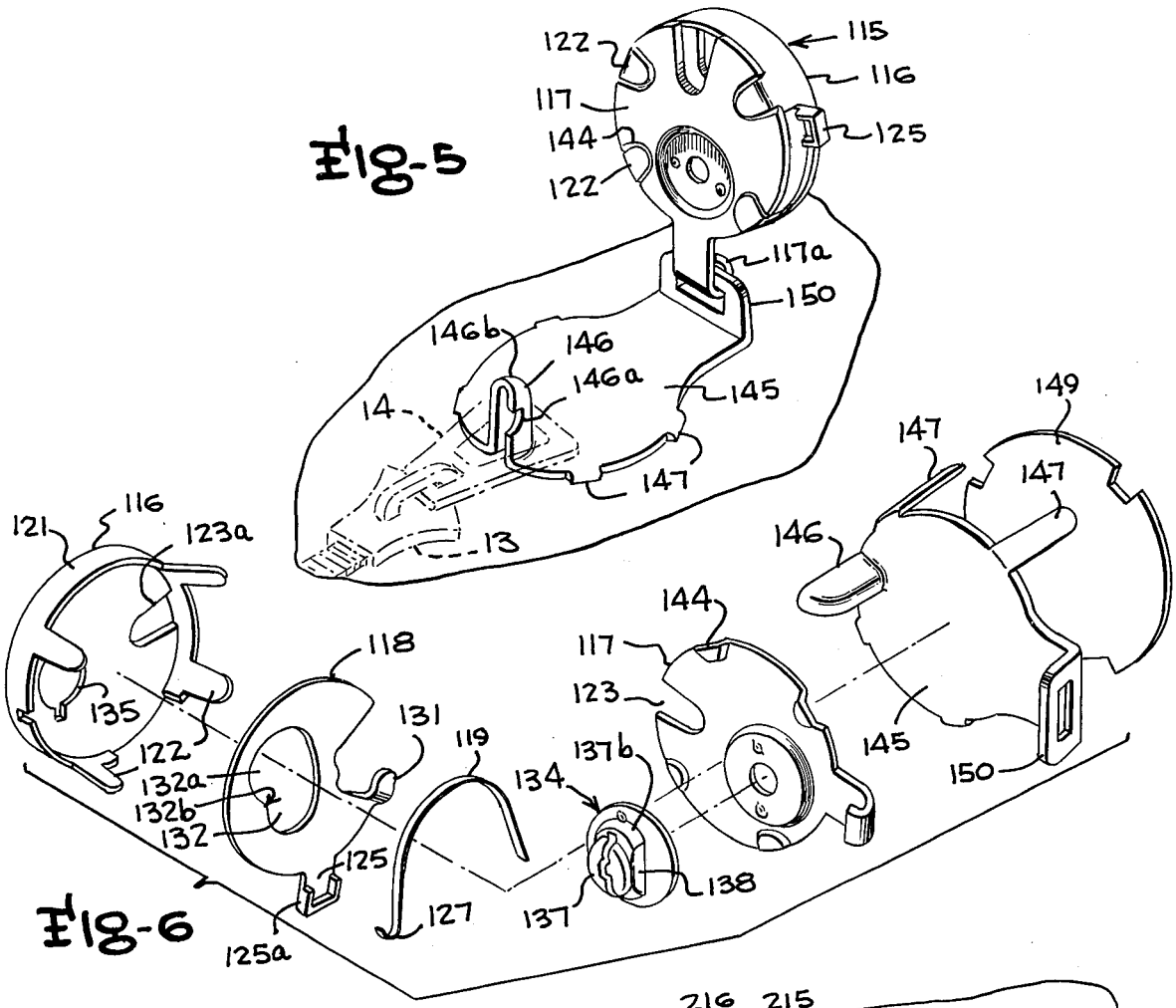
Fig-5
Fig-6
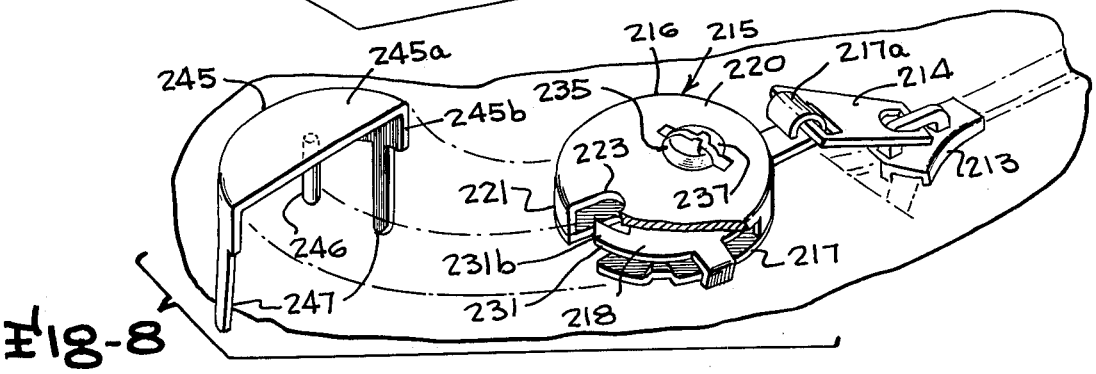
Fig-8
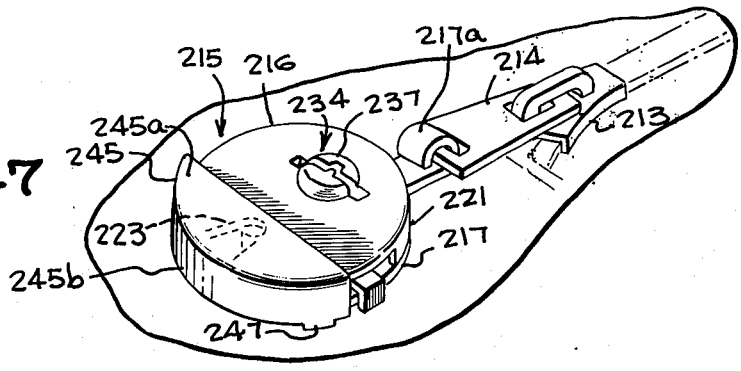
Fig-7

KEY CONTROLLED LOCK MECHANISMS FOR ZIPPER FASTENERS

BACKGROUND AND OBJECTS OF THE INVENTION

The present invention relates in general to a key controlled lock mechanism for zipper type slide fasteners, such as on softsided luggage, sports equipment bags, article covers, and the like, and more particularly to a lock and latch mechanism having a manually operable, arcuately movable latch plate and a key controlled bolt member incorporated in a housing which may be optionally hinged to a zipper fastener pull member or may be releasably coupled thereto, capable of use in a wide choice of installation conditions.

Zipper type slide fasteners have found wide use in a variety of types of installations as a closure for luggage, particularly of the softsided type, and as a closure for many other types of article storing receptacles. Such zipper type slide fasteners conventionally include a pair of tapes situated in side by side relation carrying rows of interlocking teeth which are actuated by a slider so as to be moved into or out of interlocking engagement with each other depending upon the direction of movement of the slider. In order to facilitate the movement of the slider, a pull tab is conventionally pivotally connected or hinged to the slider, and is generally freely movable with respect to the slider so that the pull tab can be oriented relative to the slider for pulling the latter in either one of a pair of opposite directions. Because of the nature of the pull tab as conventionally fashioned, it is frequently difficult to releasably hold the slide fastener in a position where it will be locked against operation.

A number of lock mechanisms have been proposed for such zipper type slide fastener assemblies in the past, but these have often involved lock mechanisms mounted on the slider body so that the slider may be directly locked to the fastener teeth carried by the tapes within the channel in which the slider moves. Such prior art forms of lockable sliders increase the thickness of the slider body to an undesirable degree and provide a bulky structure which is unsightly, and also involves substantial modification of the usual manufacturing process to permit incorporation or assembly of the lock mechanism with the slider body.

An object of the present invention, therefore, is the provision of a simple, reliable and attractive lock mechanism for securing the pull tab of a zipper type slide fastener assembly in locked condition when the zipper has been closed, cooperable with a keeper structure which secures the pull tab at a closed position against opening movement, wherein the lock mechanism components may be stamped from sheet metal material and assembled in a manner effecting substantial savings in materials and manufacturing costs, and which is suitable for a wide variety of zipper fastener installations and uses.

Another object of the present invention is the provision of a keylock controlled latch mechanism for zipper type slide fasteners of the type described in the immediately preceding paragraph, wherein the latch and lock components are housed in a casing of generally cylindrical configuration providing an attractive appearance, which can either be hinged to a stationary keeper plate and locked thereto in a position retaining the zipper pull tab in locked condition or can be hinged or otherwise secured to the zipper pull tab and locked to a stationary keeper.

Another object of the present invention is the provision of a key controlled latch mechanism for use with zipper type slide fasteners of the type which include a pair of slider members wherein a lock mechanism casing of the type described in either of the two immediately preceding paragraphs is hinged to one of the sliders and is capable of being locked to a keeper hinged to the other slider.

Other objects, advantages and capabilities of the present invention will become apparent from the following description, taken in conjunction with the accompanying drawings illustrating preferred embodiments of the invention.

BRIEF DESCRIPTION OF THE FIGURES

FIG. 5 is a fragmentary perspective view of another version of my zipper lock wherein the main body and keeper portions are hinged together, shown in open position;

FIG. 6 is an exploded perspective view of the lock mechanism of FIG. 5;

FIG. 7 is a fragmentary perspective view of another embodiment of my zipper lock wherein the keeper forms a hood member receiving a portion of the main body, shown on zipper luggage;

FIG. 8 is a perspective view of the embodiment of FIG. 7 showing the hood type keeper exploded away from the main body;

DETAILED DESCRIPTION OF PREFERRED EMBODIMENTS

Figure 1:
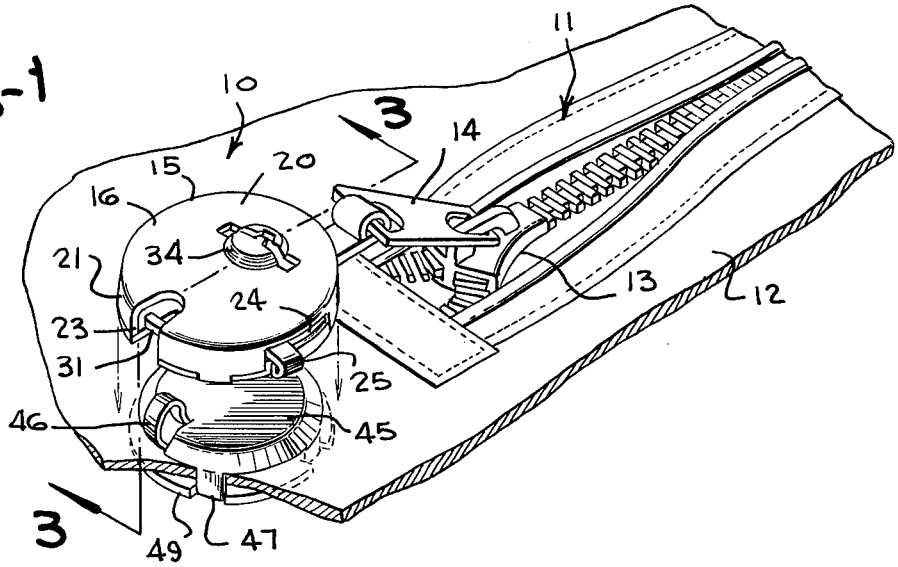
FIG. 1 is a fragmentary perspective view of a zipper lock mechanism of the present invention, for use in locking the slide member of a zipper luggage installation.

Referring to the drawings, wherein like reference characters designate corresponding parts throughout the several figures, and referring particularly to FIGS. 1–4, there is disclosed a key controlled lock mechanism, indicated generally by the reference character 10, for zipper type slide fasteners as indicated generally by the reference character 11, such as may be provided on zipper luggage 12. The zipper type slide fastener 11 has the conventional pair of tapes each having rows of conventional interlockable fastener elements or teeth which are positioned by the slide member 13 to interlock when the slide member is moved in one direction and to be disengaged when the slide member 13 is moved in the other direction. The slide member 13 of the zipper type slide fastener in the embodiment of FIGS. 1–4 has a closed loop type pull tab 14 to which the main body portion of the lock mechanism is coupled.

The main body portion 15 of the lock mechanism comprises a generally cup-shaped casing or housing member 16 assembled to a substantially circular backing plate 17 with an angularly movable or rotatable latch plate 18 interposed therebetween and spring loaded by a spring member 19. The cup-shaped cylindrical casing 16 has a circular front wall 20 forming a front cover for the lock mechanism bounded peripherally by a rearwardly extending flange wall 21 having a plurality of bendable assembly tabs 22 extending therefrom at circumferentially spaced positions. The flange wall 21 is interrupted by a first slot 23' communicating with a radially inwardly extending cutout **23*a* in the front cover or wall 20 to form a socket 23 for receiving a keeper post formation or protrusion as later described and is further interrupted by a somewhat more circumferentially elongated slot 24 for accommodating a radially outwardly extending finger piece or shifting lever 25 on the latch plate 18 through a desired range of angular movement of the latter. A small anchor slot 26 is also provided in the flange wall 21 providing an anchor for the outwardly flaring end tab 27 on one end of the biasing spring 19.**

The arcuately shiftable or rotary latch plate 18 is of generally circular configuration having the radially outwardly projecting finger piece or shifting lever 25 extending therefrom through the slot 24 and having immediately adjacent the root of the finger piece 25 a short anchor tab 28 bent forwardly and formed from a portion of the latch plate 18, leaving the slot **28*a* therein, to provide an anchor for the other outwardly flaring end tab 29 of the spring 19. A generally L-shaped cutout 30 is formed in the circular portion of the latch plate 18 extending inwardly from the periphery thereof shaped to leave a latch tongue formation 31 at one side of the entrance throat 30*a* to the cutout 30 and a specially shaped intermediate recess 32 is provided in the circular portion of the latch plate 18 lying just to the opposite side of its center axis from the L-shaped cutout 30 to accommodate a disc-like combination key barrel and bolt member 34.**

The combination key barrel and bolt member 34 forms a one piece locking mechanism of simple construction similar to the type disclosed in my earlier U.S. Pat. Nos. 3,245,236 and 3,527,067, for example, which is supported for rotation about its center axis in the circular opening 35 provided in the front wall 20 of the cup-shaped casing 16. The combination key barrel and bolt member 34 may be conveniently stamped from a generally circular piece of sheet metal shaped to provide a flat peripheral flange or rim portion 36 occupying a rear plane and having a forwardly projecting stepped central dome portion 37 of generally cylindrical configuration which provides a smaller diameter forward circular formation **37*a* and a larger diameter intermediate collar formation 37*b* which is cylindrical over most of its extent. A diametric slot 39 is formed in the front wall of the forward circular formation 37*a* and may extend into the cylindrical side wall or flange portion thereof, and passes entirely through the key barrel and bolt member to receive the key bit. The circular formation 37*a* at the forward end of the dome formation is of appropriate diameter to be received in and journalled by the circular opening 35 in the front wall of the cup-shaped casing 16. The larger diameter intermediate collar portion 37*b* of the dome-shaped portion of the disc is interrupted by a flat inset portion 38 which extends along a chord of the circle defined by the remainder of the circumference of the intermediate collar formation 37*b*. The shaped intermediate recess 32 in the latch plate 18, as will be evident from FIG. 4, has a substantially circular portion 32*a* corresponding in diameter to the circular portion of the intermediate collar formation 37*b* and the combination key barrel and bolt member 34 is normally positioned so that its collar formation 37*b* nests in this circular portion 32*a* in close conformity to the edges thereof at least along those portions near the perimeter of the plate 18 to prevent any opening movement of the latch plate 18. When, however, the combination key barrel and bolt member 34 is rotated by an appropriate key through 180° from the position illustrated in FIG. 4, the flat inset portion 38 thereon assumes a position in the path of opening movement of the nose formation 32*b* in the recess 32 which will allow passage of the nose formation alongside the flat and thereby accommodate opening arcuate movement of the latch plate 18. A raised circular platform 40 is stamped in the backing plate 17 and is provided with two locating diametrically opposite detent noses 41 coactive with the detent socket formations 42 on the flange or rim 36. Also, a cutout 43 is provided near the perimeter of the backing plate 17 to register with the cutout 23' in the casing member 16 and coacts therewith to define the socket 23 for receiving a keeper post or loop formation, and circumferentially spaced forwardly impressed wells 44 may be provided adjacent the edge of the backing plate 17 to accommodate the inwardly bent mounting tabs in slightly recessed relation. An extension tab 17*a* having a curled outer end curves through the pull tab 14** and connects the lock body thereto.

Figure 2:
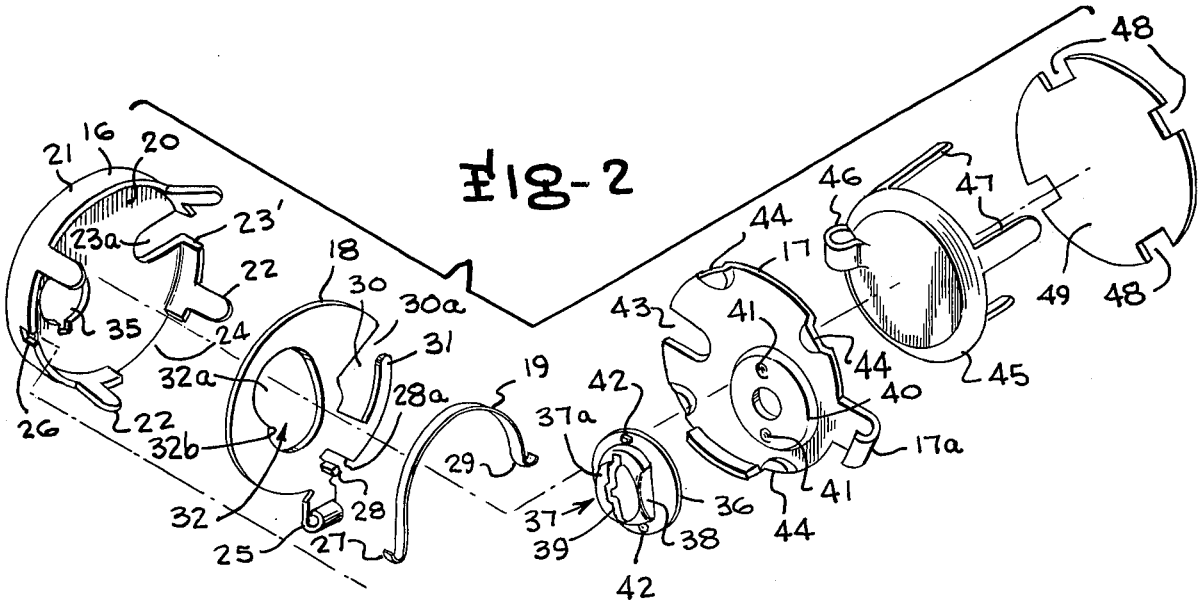
FIG. 2 is an exploded perspective view of the lock mechanism.
Figure 4:
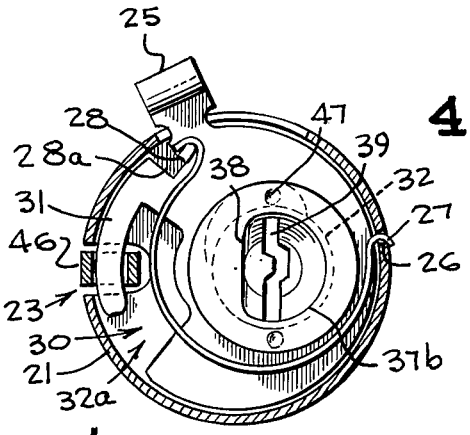
FIG. 4 is a section view taken along the line 4—4 of FIG. 3 immediately inwardly of the casing front wall, shown in locked condition.
Figure 3:
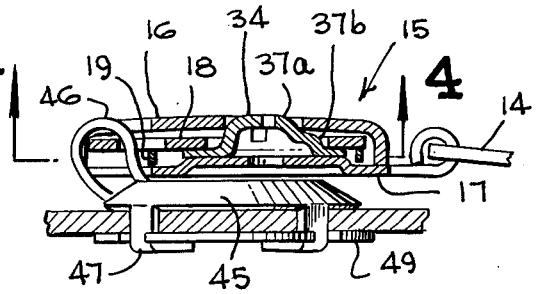
FIG. 3 is a section view taken along the line 3—3 of FIG. 1.

A suitable stationary keeper for use with this lock mechanism is illustrated in FIGS. 1 and 2, which may comprise a circular keeper plate 45 having a raised loop 46 pressed from a narrow strap portion of the keeper plate 45, in the illustrated embodiment and having an appropriate size to interfit in the socket 23 and integral pointed fastening prongs 47. The fastening prongs 47 may extend from the periphery of the circular keeping plate 45, to be pressed through fabric forming adjacent wall portions of the associated luggage and then be bent inwardly behind indentations therefor, as shown at 48 in FIG. 2, adjoining the edges of the flat circular backup plate 49. Alternatively, slots may be formed in the backup plate 49 corresponding to the cross-section and location of the prongs 47 through which the prongs may be passed and then be bent rearwardly behind the backup plate to securely fasten the keeper assembly to the fabric wall.

Referring now to FIGS. 5 and 6, there is shown a modified version of the zipper lock structure wherein the main body portion and keeper portions are hinged together, but wherein the components are generally similar to those in the previously described embodiment. The components of the FIG. 5 and 6 embodiment which correspond substantially to the components of the FIG. 1–FIG. 4 embodiment are indicated by reference characters in the 100 series in which the last two digits correspond to the digits of the corresponding components of the FIG. 1–4 embodiment. In the form of FIG. 5–6, the main body portion 115 is formed basically of a casing 116 similar in configuration to the casing 16 of the first described embodiment, assembled to a backing plate 117 by bendable assembly tabs 122 bent rearwardly about the backing plate into indentations or wells 144 therein, and having an angularly movable or rotatable latch plate 118 biased normally to a latched position by a curved flat spring member 119. The latch plate 118 has a shaped intermediate recess 132 shaped in a manner similer to the intermediate recess 32 and coactively receiving the stepped dome portion 137 of the combination key barrel and bolt member 134 in the same manner as in the previously described embodiment.

The main body portion 115 in this embodiment, however, is hinged to the keeper plate 145, rather than being completely removable therefrom as in the previously described embodiment, by extending the curled tab portion 117*a* of the backing plate 117, which in this embodiment forms a hinge tongue, through the slotted flange formation 150 extending upwardly from the keeper plate 145 at a selected location along the perimeter thereof and forming, in effect, a hinge knuckle member. The main body portion 115 of this lock embodiment is designed to swing, in a manner similar to a hinged hasp, about the hinge formation defined by the slotted flange 150 and the curved tongue portion 117*a*, from an open position as illustrated in FIG. 5, to a closed position wherein the main body portion is latched in closely adjacent covering relation to the keeper plate 145. The keeper plate 145 has an upwardly or outwardly projecting post formation 146, instead of the raised loop 46 of the keeper plate 45, and this post formation 146, which projects perpendicularly from the keeper plate 145, is of appropriate height to receive either the apertures of a pair of apertured pull tabs associated with a pair of sliders of a double zipper slide installation or to receive the aperture of the apertured pull tab of the slider of a single slider sipper installation. With the apertured pull tab or pair of pull tabs thus positioned on the post formation 146, the main body portion 115 can then be swung about its hinge axis to the closed position and locked in such closed position, thereby securely fastening the zipper slide or pair of slides against movement from the closed position.

The latch plate 118 is very similar to the latch plate 18 of the previously described embodiment, having the intermediate shaped recess 132, as previously described, for receiving the stepped dome portion of the combination key barrel and bolt member 134, and having a finger piece or shifting lever 125 similar to that of the earlier embodiment, and is resiliently biased to the latch position by the spring 119 having one curved end 127 seated in an appropriate slot in the circumferential flange wall 121 of the casing 116 and having its other end, in this embodiment, extending into the finger piece 125 and bearing against one of the rearwardly bent rims or flange formations 125*a* bounding the side and outer end edges of the finger piece in this embodiment.

The front wall 120 of the casing 116 is provided with a cutout 123*a* to permit passage of the upper end portion of the keeper post 146 therethrough but the adjacent circumferential flange wall 121 is not interrupted at this location, thus omitting the slot 23' which was present in the first described embodiment. The keeper post 146, in this embodiment, is provided with a notch 146*a* in its side facing the latch plate tongue 131, to receive the latch plate tongue therein in the latching condition, and, as will be evident from inspection of FIG. 6, the latch tongue formation 131 is somewhat foreshortened compared to the tongue formation 31, and is slightly beveled or rounded on its end portion which bears against the side of the keeper post 146 in a direction generally facing the keeper. This shaping of the tongue formation 131 is provided to coact with the rounded and shaped nose portion at the free end of the keeper post 146, as indicated at 146*b*, to cam the latch tongue and latch plate in a releasing or unlatching direction when the rounded nose portion 146*b* of the keeper post engages the beveled end of the latch tongue 131 during movement of the main body portion 115 to the closed position nearest the keeper plate, at the conclusion of which the latch plate then snaps closed to the latching position when the free end of the latch tongue registers with the notch 146*a*. The latch plate is locked against unlatching movement from latching position when the combination key barrel and bolt member 134 is positioned so that the circular portion of the collar formation 137*b* abuts the concave circular portion of the recess 132*a* immediately adjacent the nose 132*b*, and releases the latch plate 118 for unlatching movement when the flat portion 138 is positioned in the angular path of movement of the nose formation 132*b*, in the same manner as in the first described embodiment.

The keeper plate portion 145 of this embodiment may include bendable fastening prongs 147 designed to extend through the fabric wall of the associated luggage or container and be bent rearwardly around the periphery of a backup plate 149 having indentations for receiving the end portions of the fastening prongs, in a manner similar to the previously described embodiment. Alternatively, rivet holes may be provided in the keeper plate 145 and in the associated backup plate to pass rivets through them and through the fabric and achieve fastening of the keeper plate to the luggage in a well-known manner.

Yet another embodiment, illustrative of the versatility of this lock construction, is shown in FIGS. 7 and 8, adapted also for locking the slide component of a zipper assembly forming the closure for luggage or other containers, wherein the main body portion is formed of the same basic construction as that of the two previously described embodiments, with slight variation in the shape and length of the end portion of the latch tongue formation. In the embodiment of FIGS. 7 and 8, the components are indicated by reference characters in the 200 series, with the last two digits of the reference characters for those components which correspond to components of the FIG. 1–4 embodiment being the same as the reference characters for the first described embodiment. The main body portion of the FIG. 7–8 embodiment is indicated by the reference character 215 and comprises a casing 216 and backing plate 217 and spring member like the casing, backing plate and spring member 19 of the first embodiment. The casing 216 has a circular opening 235 in the front wall 220 thereof to receive the smaller diameter circular portion of the dome formation 237 of the combination key barrel and bolt member 234, like the smaller diameter portion 37*a*. The casing 216 also includes a cutout which joins with a slot in the flange wall 221 of the casing, like the cutout 23*a* and slot 23', coacting with a cutout in the backing plate 217 like the cutout 43 of the first embodiment to define a socket 223 for receiving the keeper protrusion. The backing plate 217 may have peripheral indentations for the assembly tabs projecting from the front casing, like the indentations 44 of the first embodiment, and additionally includes a raised circular platform having detent noses thereon to coact with the key barrel and bolt member 234 in the same manner as the raised platform 40 and detent noses 41 of the first embodiment. Also, a curved connecting extension 217*a* protrudes from the circular peripheral portion of the backing plate 217 to extend through the opening in the loop type pull tab 14 of the zipper slider 13 in the same manner as the first embodiment. A rotatable or angularly movable latch plate 218 is interposed between the backing plate 217 and the front wall of the casing 216 and has the same shape as the latch plate 18 of the first described embodiment except that the latch tongue formation 231 thereon is somewhat shortened so that it spans only about half the width of the socket 223, instead of completely spanning this socket as in the first embodiment, and is shaped to provide a beveled or inclined outwardly facing edge portion 231*b* forming a coming surface to coact with the keeper protrusion in causing the latching plate to be retracted and then snapped shut when it is moved to latched position relative to the keeper.

The keeper in the embodiment of FIGS. 7 and 8, indicated generally by the reference character 245, is shaped to form a truncated cylindrical hood or cowling to receive the lower part of the cylindrical main body portion 215 of the lock in nested relation therein, and comprises a truncated circular front wall 245*a* approximating a semicircle bounded by a flange wall 245*b* along the curved edge of the front wall defining a concavely curved side wall extending rearwardly to the surface of the wall of the luggage or container on which the keeper is to be mounted. The hood-like keeper may, or may not, be provided with a rear wall which would forwardly overlie the luggage wall, as desired. The curved side wall 245*b* includes a plurality of circumferentially spaced rearwardly extending fastening prongs 247 adapted to be forced through the fabric and bent inwardly about the rear of a backup plate (not shown) preferably having indentations into which the end portions of the prongs are bent or having slots through which the prongs are passed and then bent rearwardly against the back surfaces of the backup plate. Also in the illustrated embodiment, the keeper protrusion which is to be latched in the socket 223 is in the form of a circular cross section rigid post 246 which preferably extends the full depth of the keeper hood formation from the front wall 245*a* to the luggage surface on which the keeper is mounted and provides a cylindrical surface against which the inclined camming edge portion of the latching tongue formation 231 bears as the cylindrical latch body portion 215 is inserted into the recess defined by the hood shaped keeper. The shape of the interengaging portions of these members causes the latch plate to be forced to rotate a sufficient amount against the biasing force of the spring therein corresponding to the spring 19 to permit the keeper post 246 to pass to the portions of the latching socket 223 located inwardly of the latching tongue formation whereupon the latching plate snaps back to the latching position under the force of its spring to latch the keeper post in the latching slot. Since the semicylindrical or truncated cylindrical recess defined by the hood shaped keeper 245 corresponds closely to the shape of the portion of the cylindrical main body portion 215 which is received therein, the hood shaped keeper retards side motions of the lock body as well as holding the lock body in latched relation therewith and prevents the engaging end of the latch plate tongue formation from accidentally slipping off the keeper post. It will be appreciated that the keeper post may either be secured to and extend rearwardly from the front wall of the keeper hood formation, or from a rear wall of the hood formation, if present, or it may be secured to and extend forwardly from the backup plate and protrude through a suitably shaped opening formed therefor in the adjacent wall of the luggage or receptacle with which the lock assembly is to be associated.

It will also be appreciated that instead of having a spring biased rotatable or angularly movable latch plate 18, or 118, or 218 of the above described embodiments, the latch plate may be in the nature of a dead latch release which is merely detented by detent nose and socket formations on the backup plate and latch plate, similar to the detent noses 41 and sockets 42 releasably locating the combination key barrel and bolt member 34, to releasably locate the latch plate in either the latching or unlatching position. Of course the combination key barrel and bolt member 34 in such a modification would lock the latch plate against movement from the latching position when adjusted by an appropriate key to the locking position, as in the previously described embodiments.

Figure 9:
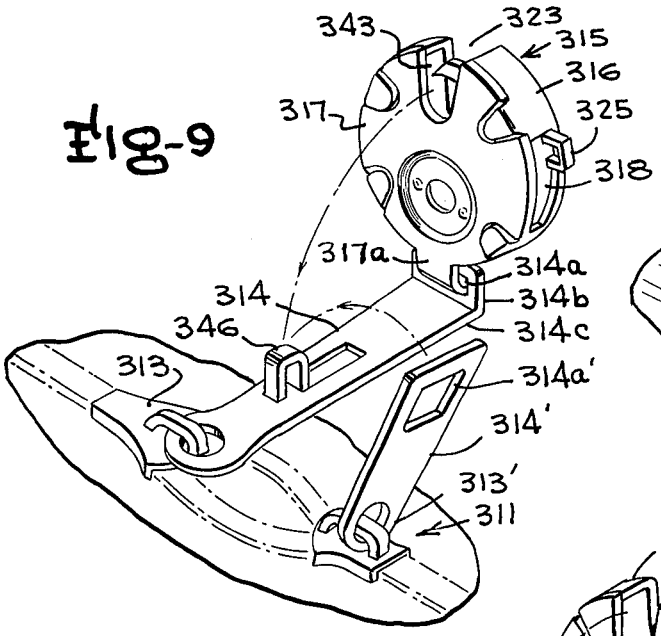
FIGS. 9 and 10 are perspective views of another embodiment of my zipper lock adapted for use with double slider zipper fasteners, showing the lock in open and in locked positions respectively.
Figure 10:
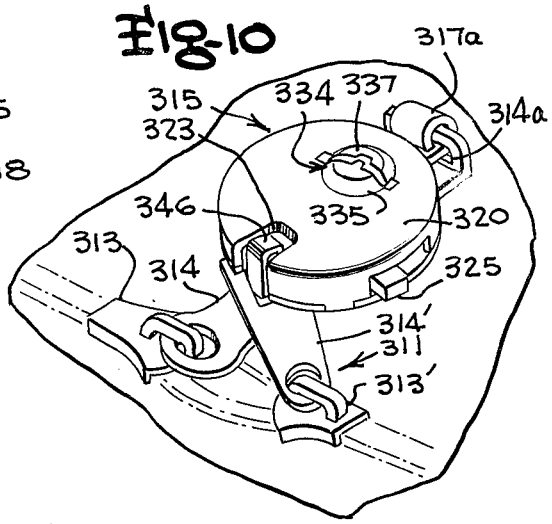

Still another embodiment of this lock construction is illustrated in FIGS. 9 and 10, wherein the lock is adapted for use with double slider zippers by hinging the lock to one of the pull tabs modified to permit locking of the other pull tab thereto between the first mentioned pull tab and the lock body. In the form illustrated in FIGS. 9 and 10, the components are indicated by reference characters in the 300 series, with the last two digits of the reference characters for those components which correspond to components of the FIGS. 1–4 embodiment being the same as the reference characters for the first described embodiment. The main body portion of the FIGS. 9–10 embodiment is indicated by the reference character 315 and comprises a casing 316 and backing plate 317 assembled together and enclosing a spring biased latching plate 318 having a radially extending finger piece 325, all similar to the casing, backing plate and latch plate of the first embodiment. The casing 316 has a circular opening 335 in the front wall 320 thereof to receive the smaller diameter circular portion of the dome formation 337 of the combination key barrel and bolt member 334, like the smaller diameter circular portion 37*a* of the dome formation 37 of key barrel/bolt member 34. The backing plate 317, like the backing plate 117 of the FIG. 5 embodiment, includes a cutout shaped to receive a keeper loop like the keeper loop 46 of the keeper 45 of the FIG. 1 embodiment, to be interlocked with the end portion of the latch tongue on the latch plate 318. The backing plate 317 may have peripheral indentations for the assembly tabs projecting from the front casing and additionally includes a raised circular platform having detent noses thereon to coact with the key barrel and bolt member 334 in the same manner as the raised platform 40 and detent noses 41 of the FIG. 1 embodiment. A rotatable or angularly movable latch plate 318 is interposed between the backing plate 317 and the front wall of the casing 316 and has the same shape as the latch plate 18 of the FIG. 1 embodiment. As illustrated most clearly in FIG. 9, the curved connecting extension 317*a* of the backing plate 317 which protrudes from the circular peripheral portion of the backing plate extends through a slot 314*a* of the upwardly extending right angle terminal flange 314*b* at the outer or free end of the elongated flat panel portion 314*c* of the pull tab 314, the opposite end of the panel 314*c* being apertured to pivotally couple the pull tab to the tab mounting loop on one of the zipper sliders 313 of the double slider zipper closure 311. Spaced an appropriate distance from the hinge forming flange 314*b* of the pull tab 314 is a loop type keeper formation 346 similar to the keeper loop 46 of the FIG. 1 embodiment, designed to be received in the keeper receiving socket 323 when the lock body 316 is swung downwardly to closed co-planar relation adjacent the flat panel portion 314*c* of the pull tab 314. The pull tab 314' associated with the other zipper slider 313' forming the other slider of the double slider zipper fastener is pivotally linked to its associated slider 313' in the usual manner and has an aperture 314*a'* adjacent its free end of appropriate size to receive and be passed downwardly over the keeper loop 346 of the pull tab 314 between the pull tab panel 314*c* and the lock body 316 before the lock body 316 is swung down to the closed position to capture the pull tab 314' between the pull tab 314 and the lock body 316 and thereby effect locking of the double slider zipper fastener.

Figure 11:
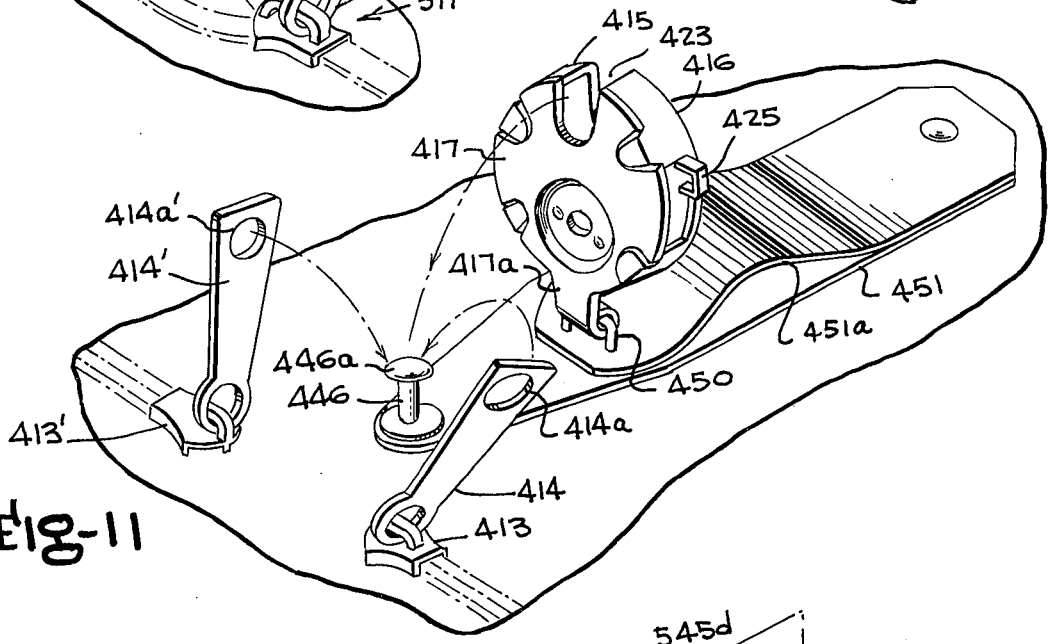
FIG. 11 is a perspective view of yet another embodiment of my zipper lock for use with double slider zippers.

FIG. 11 illustrates yet another form of the lock mechanism adapted for double slider zipper fasteners, wherein the lock body, indicated by the reference character 415 is substantially identical to the lock body 215 of the FIG. 7–8 embodiment except that the curved connecting extension 417*a* protruding from the circular peripheral portion of the backing plate is fastened by a staple or similar fastening element 450 to an upper strap 451*a* fastened to the luggage side wall and overlying a longer strap 451 having a free end portion which carries a keeper post 446 rigidly fixed thereon having a cylindrical shank portion sized to be received in the cutout or recess 423 of the lock casing 416 and having an enlarged head 446*a* at the upper end of the shank portion of larger diameter than the span of the keeper receiving recess 423 in the lock casing. The pull tab 414 and 414' of the companion sliders 413, 413' each have a hole 414*a*, 414*a'* therein of appropriate size to receive the head 446*a* and the constricted diameter shank portion of the keeper post 446 therethrough. It will be apparent, therefore, that the companion pull tabs 414, 414' associated with the sliders 413, 413' can be captured between the strap 451 and the lock body 416 on the keeper post 446 extending through the hole in the pull tabs before the lock body 415 is latched onto the keeper post 446 to lock the double slider zipper fastener in closed position.

Figure 12:
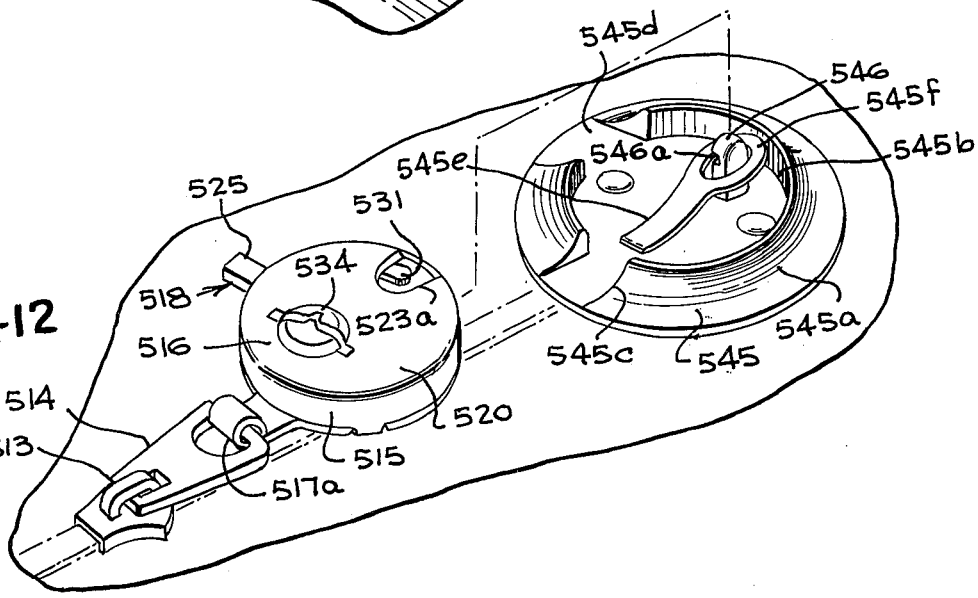
FIG. 12 is a perspective view of a further embodiment of my zipper lock.

Still another embodiment is illustrated in FIG. 12, wherein the lock body 515 is like the lock body 15 of the FIG. 1 embodiment, having a similar cup-shaped cylindrical casing 516 providing the circular front wall 520 in which the forwardmost circular portion of the dome formation of the combination key barrel and bolt member 534 is journalled and having a cutout defining the recess 523 into which the tongue formation 531 of the latch plate 518 projects in the locking position. The main lock body 515 of the FIG. 12 embodiment also has the rigid curved extension tab 517*a* curved through the loop of the pull tab 514 associated with the zipper slider 513. The keeper member 545, however, is somewhat different from the keeper 45 of the FIG. 1 embodiment, in that the keeper member 545 is of circular configuration having a larger diameter than the diameter of the cylindrical casing or lock body 515, providing a beveled or flared annular shield formation 545*a* surrounding a cylindrical well 545*b* of appropriate diameter to receive the cylindrical lock body 515 nested therein. The shield formation 545*a* is interrupted at 545*c* to accommodate the extension tab 517*a* when the lock body 515 is nested in the well 545*b*, and also has a recess or interruption 545*d* of limited circumferential extent appropriately positioned to accommodate the finger piece 525 of the latch plate 518 and permit its manual movement circumferentially between locking and release positions. Rising from the base wall of the recess 545*b* in the keeper member 545 is the keeper post 546 which in the illustrated embodiment is similar to the keeper post 146 of the FIG. 5 embodiment and has a side opening recess 546*a* therein to receive the end portion of the latch plate tongue formation 531 in latching engagement therein when the backing plate portion of the lock body 515 is substantially against the bottom wall of the well 545*b*. Also provided in the well 545*b* is a kicker spring 545*e* of leaf spring construction in the illustrated embodiment, having one free end thereof secured in any appropriate manner against the base wall of the well 545*b* and having an annular free end portion 545*f* at the opposite end providing an aperture of slightly larger cross-sectional size than the keeper post 546 to surround the keeper post and permit the latter to project therethrough. The kicker spring 545*e* is normally resiliently biased to a position wherein the end 545*f* thereof is spaced outwardly from the base wall of the well 545*b* to lie near the side opening notch 546*a* in the keeper post. However, when the lock body 515 is positioned in nested latched relation in the well 545*b* with the latch tongue 531 interlocked in the latching notch 546*a* of the keeper post, the kicker spring 545*e* is flexed to a stressed condition lying flat against the base wall of the well 545*b*, storing energy which is released to eject the lock body 515 from the keeper well 545*b* whenever the latch tongue 531 is withdrawn from the keeper notch 546*a*. As in the case of FIGS. 7–10, other components of the embodiment of FIG. 12, and of the embodiment of FIG. 11, corresponding to components of the previously described embodiments, are indicated by reference characters in the 500 series or 400 series whose last two digits correspond to the reference characters of FIGS. 1–4.

What is claimed is:

1. A key controlled lock mechanism for locking in closed position the zipper slider of a separable zipper-type fastener, comprising a lock member formed in the shape of a thick circular disc-like lock body of small axial thickness relative to its diameter, the disc-like lock body including a cup shaped casing forming a thin walled casing shell of generally cylindrical configuration having a circular front wall bounded by a rearwardly projecting annular rim flange and including a circular backing plate fastened thereto at the rearmost rear portions of said rim flange to define a cylindrical lock chamber between said backing plate and front wall, a circular latch plate having a diameter approximating the diamter of said chamber supported by sliding peripheral contact with the outwardly surrounding rim flange for rotary angular movement about the center axis of the lock body between latching and release positions and having a radially outwardly projecting finger piece extending beyond the rim flange forming a manually operable shifting tab for movement of the latch plate toward the release position, the circular latch plate having a peripheral cut-out shaped to define a circumferentially extending latch tongue adjacent its periphery and having a shaped intermediate recess near and eccentric of its center shaped to coact with a key-operable locking disc, a locking disc journaled at a fixed station in the casing for rotation in said recess about an eccentric axis offset from said center axis having a key slot for rotation of the locking disc by a key inserted therein and having a locking surface extending in a generally circular path confronting the boundary surfaces of the intermediate recess to restrain the latch plate against rotation from said latching position and to free the same for rotation to release position at locking and unlocking positions respectively of the locking disc, means defining a keeper formation insertable into the casing for securing the slider in the closing position, and said casing having recesses for accommodating circumferential movement of said finger piece and for admitting the keeper formation into the casing into latched coupling engagement with said latch tongue.

2. A key controlled lock mechanism as defined in claim 1, wherein said locking disc includes a circular journal surface interfitted in a circular opening in said front wall journaling the locking disc for rotation and includes a substantially circular collar surface interrupted by an inset gate spaced rearwardly from the journal surface and located in the plane of the latch plate within said intermediate recess, and said intermediate recess of the latch plate having a boundary surface portion shaped to conform to and receive circular portions of the collar surface at said latching position and a passage extending therefrom for accommodating portions of the locking disc upon relative movement of the latch plate to release position, and the latch plate having a nose formation bordering said boundary surface portion located relative to the collar surface when the disc is in locking position to obstruct movement of the latch plate from latching position toward release position and sized to pass through the inset gate when the locking disc occupies the unlocking position to accommodate latch plate movement to the release position.

3. A lock mechanism as defined in claim 1, wherein the zipper slider includes a closed loop-type pull tab coupled to the slider, and said lock body includes a hinge knuckle formation extending from said casing through the loop of said pull tab for hingedly coupling the lock body thereto.

4. A lock mechanism as defined in claim 2, wherein the zipper slider includes a closed loop-type pull tab coupled to the slider, and said lock body includes a hinge knuckle formation extending from said casing through the loop of said pull tab for hingedly coupling the lock body thereto.

5. A locking mechanism as defined in claim 3, including a stationary keeper member formed of a substantially flat circular base plate portion substantially coextensively conforming to the configuration of said backing plate of the disc-like lock body to be anchored to a wall portion of a container to be closed by the zipper fastener adjacent the zipper slider when disposed in said closing position and located in underlying registered relation with the disc-like lock body, the circular base plate having a keeper post formation rising therefrom to enter the disc-like lock body into latched relation with said latch tongue.

6. A locking mechanism as defined in claim 4, including a stationary keeper member formed of a substantially flat circular base plate portion substantially coextensively conforming to the configuration of said backing plate of the disc-like lock body to be anchored to a wall portion of a container to be closed by the zipper fastener adjacent the zipper slider when disposed in said closing position and located in underlying registered relation with the disc-like lock body, the circular base plate having a keeper post formation rising therefrom to enter the disc-like lock body into latched relation with said latch tongue.

7. A locking mechanism as defined in claim 5, wherein said keeper post formation is a shaped sheet metal post of generally channel shaped cross-section defining side walls having a lateral opening in one of the side walls to receive end portions of the latched tongue therein.

8. A locking mechanism as defined in claim 6, wherein said keeper post formation is shaped sheet metal post of generally channel shaped cross-section defining side walls having a lateral opening in one of the side walls to receive end portions of the latched tongue therein, spring means resiliently urging the latch plate toward locking position, and the keeper post formation and end portion of the latched tongue being cooperatively shaped to effect camming of the latch tongue toward release position upon interengagement thereof during movement of the lock body to locking position in overlying registration with the circular base plate of the keeper member.

9. A locking mechanism as defined in claim 7, wherein the keeper post formation is in the form of a closed loop of sheet metal rising from the circular base plate to receive the latch tongue end portion in the loop formed thereby in locking position.

10. A lock mechanism as defined in claim 3, wherein said disc-like lock body includes a recess for receiving the keeper formation into the casing in coupled relation with the latch tongue, and said keeper formation includes a keeper post to be received in the keeper receiving recess and restrained therein by the end portion of the latch tongue and a substantially semi-circular hood formation outwardly covering and extending about the keeper post defining a semi-cylindrical shroud sized and shaped to receive portions of said lock body adjacent the keeper receiving recess in nested and protected relation therein.

11. A lock mechanism as defined in claim 3, wherein the means defining the keeper formation includes a stationary keeper member having a circular base of larger diameter than the disc-like lock body shaped to define an outwardly opening circular well for receiving the lock body in nested relation therein and defining a tapered annular shield formation outwardly surrounding the well, said well having a depth corresponding to a major portion of the axial thickness of the disc-like lock body, the keeper formation being a rigid keeper post rising from the base wall of the circular well having a side opening notch therein to be interlocked with the end portion of the latch tongue, and the keeper member including a kicker leaf spring member mounted at one end against the base wall of the well spaced from the keeper post and having a free end portion normally resiliently spaced outwardly from the base wall and lying adjacent the keeper post to be engaged by the lock body and flexed to a stressed position against the base wall of the well when the latched tongue enters the side opening notch of the keeper post whereby the kicker spring resiliently ejects the lock body from the well upon decoupling of the latched tongue from the keeper post notch.

12. A lock mechanism as defined in claim 4, wherein the means defining the keeper formation includes a stationary keeper member having a circular base of larger diameter than the disc-like lock body shaped to define an outwardly opening circular well for receiving the lock body in nested relation therein and defining a tapered annular shield formation outwardly surrounding the well, said well having a depth corresponding to a major portion of the axial thickness of the disc-like lock body, the keeper formation being a rigid keeper post rising from the base wall of the circular well having a side opening notch therein to be interlocked with the end portion of the latch tongue, and the keeper member including a kicker leaf spring member mounted at one end against the base wall of the well spaced from the keeper post and having a free end portion normally resiliently spaced outwardly from the base wall and lying adjacent the keeper post to be engaged by the lock body and flexed to a stressed position against the base wall of the well when the latched tongue enters the side opening notch of the keeper post whereby the kicker spring resiliently ejects the lock body from the well upon decoupling of the latched tongue from the keeper post notch.

13. A locking mechanism as defined in claim 3, for use with a zipper-type fastener having two zipper sliders moveable in opposite directions to closing positions adjacent one another, one of said pull tabs having said keeper formation rigidly formed thereon and insertable into the casing into interlocked relation with the latching tongue, and the other of said pull tabs having an aperture therein of sufficient size to pass said keeper post therethrough whereby said other pull tab may be latched between the first pull tab and said lock body with the keeper post extending through the aperture in said other pull tab.

14. A locking mechanism as defined in claim 4, for use with a zipper-type fastener having two zipper sliders moveable in opposite directions to closing positions adjacent one another, one of said pull tabs having said keeper formation rigidly formed thereon and insertable into the casing into interlocked relation with the latching tongue, and the other of said pull tabs having an aperture therein of sufficient size to pass said keeper post therethrough whereby said other pull tab may be latched between the first pull tab and said lock body with the keeper post extending through the aperture in said other pull tab.

15. A lock mechanism as defined in claim 13, wherein the one pull tab has an elongated flat panel portion coupled at one end to its associated slider and terminating at the other end at a flange extending at an angle to the plane of the flat panel and having the loop therein through which the knuckle formation extends from the lock body to hingedly couple the lock body to the flange of the pull tab for pivotal movement toward and away from the associated pull tab about a hinge axis paralleling the plane of the flat panel, and the one pull tab having said keeper formation rising therefrom spaced an appropriate distance from the hinge axis to enter the lock body and be received in latched coupling engagement with the latch tongue.

16. A lock mechanism as defined in claim 4, wherein the one pull tab has an elongated flat panel portion coupled at one end to its associated slider and terminating at the other end at a flange extending at an angle to the plane of the flat panel and having the loop therein through which the knuckle formation extends from the lock body to hingedly couple the lock body to the flange of the pull tab for pivotal movement toward and away from the associated pull tab about a hinged axis paralleling the plane of the flat panel, and the one pull tab having said keeper formation rising therefrom spaced an appropriate distance from the hinge axis to enter the lock body and be received in latched coupling engagement with the latch tongue.

17. A lock mechanism as defined in claim 1, wherein the zipper slider has a closed loop-type pull tab coupled to the slider, and the means defining said keeper formation comprising a flat keeper plate having a round portion conforming substantially to the circular configuration of the disc-like lock body with an integral extension terminating in a slotted flange extending at an angle from the keeper panel portion forming a component of a hinge coupling, the lock body including a rigid extension terminating in a curved knuckle formation extending through the slot in the slotted flange of the keeper defining a hinge connection for pivotal movement of the lock body toward and away from the keeper panel along an axis paralleling the plane of the keeper panel, and the keeper having a rigid keeper post rising from the keeper panel portion at a location spaced from the hinge connection to be received in the lock body in latched coupling engagement with the latch tongue, the keeper member having means for fastening the same to a wall of a container to be closed by the zipper-type fastener adjacent the closing position of the slider for locking the pull tab between the lock body and its keeper panel with the keeper post extending through the pull tab loop.

18. A lock mechanism as defined in claim 2, wherein the zipper slider has a closed loop-type pull tab coupled to the slider, and the means defining said keeper formation comprising a flat keeper plate having a round portion conforming substantially to the circular configuration of the disc-like lock body with an integral extension terminating in a slotted flange extending at an angle from the keeper panel portion forming a component of a hinge coupling, the lock body including a rigid extension termination in a curved knuckle formation extending through the slot in the slotted flange of the keeper defining a hinge connection for pivotal movement of the lock body toward and away from the keeper panel along an axis paralleling the plane of the keeper panel, and the keeper having a rigid keeper post rising from the keeper panel portion at a location spaced from the hinge connection to be received in the lock body in latched coupling engagement with the latch tongue, the keeper member having means for fastening the same to a wall of a container to be closed by the zipper-type fastener adjacent the closing position of the slider for locking the pull tab between the lock body and its keeper panel with the keeper post extending through the pull tab loop.

* * * * *